United States Patent [19]

Marchione

[11] Patent Number: 5,067,201

[45] Date of Patent: Nov. 26, 1991

[54] DOOR ON-DOOR OFF VEHICLE HINGE WITH ANTI-SLAP HOLD-OPEN MECHANISM

[75] Inventor: Joseph H. Marchione, Rockford, Ill.

[73] Assignee: Atwood Industries, Inc., Rockford, Ill.

[21] Appl. No.: 432,156

[22] Filed: Nov. 6, 1989

[51] Int. Cl.[5] ..... E05D 7/12

[52] U.S. Cl. ..... 16/270; 16/271; 16/332; 16/375

[58] Field of Search ..... 16/254, 270, 271, 332, 16/354, 264, 261, 272, 375

[56] References Cited

U.S. PATENT DOCUMENTS

| | | | |
|---|---|---|---|
| 2,812,536 | 11/1957 | Ragsdale | 16/332 |
| 2,992,452 | 7/1961 | Schonitzer | 16/141 |
| 3,370,317 | 2/1968 | Marchione | 16/145 |
| 4,619,016 | 10/1986 | Brockhaus | 16/383 |
| 4,720,895 | 1/1988 | Peebles | 16/264 |
| 4,794,669 | 1/1989 | Sanders | 16/375 |
| 4,864,687 | 9/1989 | Calcaterra et al. | 16/332 |

FOREIGN PATENT DOCUMENTS

| | | | |
|---|---|---|---|
| 1909335 | 9/1970 | Fed. Rep. of Germany | 16/334 |

*Primary Examiner*—Lowell A. Larson
*Assistant Examiner*—Michael J. McKeon
*Attorney, Agent, or Firm*—Leydig, Voit & Mayer, Ltd.

[57] ABSTRACT

A hinge for mounting a vehicle door for swinging between open and closed positions on a vehicle body. The hinge includes a door section adapted to be attached rigidly to the door, a body section adapted to be attached rigidly to the body, and an intermediate section pivotally connected to the door section and detachably connected to the body section in order to enable the door to be quickly removed from and re-installed on the body. To facilitate such removal and re-installation, the intermediate section of the hinge carries a pin which is adapted to fit in a notch in the body section in order to locate the door as it is being re-installed. The body section and the door section of the hinge carry components of a plunger-type hold-open mechanism which releasably holds the door in partially open and nearly fully open positions and which operates relatively silently as the door is opened and closed.

6 Claims, 2 Drawing Sheets

DOOR CLOSED
21
22
23
24
25
26
27
28
30
31
32
33
40
41
42
43
4
5
50
51A
51B
55
66
70
80
82
90
91
96
20

DOOR INTER. OPEN
21
22
24
25
26
27
28
30
33
40
41
42
43
4
6
70
71
80
82
90
91
96

FULLY OPEN
21
22
24
25
26
27
28
30
33
40
41
42
43
44
55
70
71
80
82
90
91
96
20

DOOR ON-DOOR OFF VEHICLE HINGE WITH ANTI-SLAP HOLD-OPEN MECHANISM

BACKGROUND OF THE INVENTION

This invention relates to a hinge for mounting the door of a vehicle for swinging between open and closed positions on the body of the vehicle. Such a hinge conventionally includes a door section adapted to be connected rigidly to the door and pivotally interconnected with a body section which is adapted to be connected rigidly to the body.

A vehicle door hinge usually is equipped with a hold-open mechanism which retains the door releasably in a fully open or nearly fully open position and which also may retain the door releasably in a partially open position (i.e., an intermediate position). A popular hinge with a hold-open mechanism is disclosed in Marchione U.S. Pat. No. 3,370,317. In that hinge, a torsion bar is utilized to produce the hold-open action. The torsion bar hold-open, however, is bulky and has a tendency to squeak as the door is opened and closed.

Schonitzer U.S. Pat. No. 2,992,452 also discloses a vehicle hinge with a hold-open mechanism. The Schonitzer hinge relies on a spring-loaded plunger for hold-open purposes but, like the hinge of the Marchione '317 patent, the Schonitzer hinge is bulky and takes up a significant amount of space in both the lateral and longitudinal directions.

Recent developments in vehicle hinges involve a "door on-door off" principle which is disclosed in Brockhaus U.S. Pat. No. 4,619,016. In accordance with this principle, the door is fully installed on the vehicle body at one stage of an assembly line and, during such installation, the door and body sections of the hinge are adjusted as necessary to achieve a proper fit between the door and the body. Thereafter, the door is removed from the body by disassembling the hinge but without disturbing the positional relationship between the door and the door section of the hinge and between the body and the body section of the hinge. A door on-door off hinge is designed in such a manner that, when the hinge is reassembled at a later stage of the assembly line, the positional relationship or fit between the vehicle door and body is the same as was established earlier during the adjustment stage. In this way, the door can be installed and adjusted at one point along an assembly line, the door can be removed to facilitate painting or other assembly operations, and then the door can be quickly and easily re-installed without need of further adjustment of the door relative to the body.

SUMMARY OF THE INVENTION

The general aim of the present invention is to provide a new and improved door on-door off hinge which includes a simple, compact and relatively noise-free and durable hold-open mechanism.

A more detailed object of the invention is to achieve the foregoing through the provision of a door on-door off hinge having a hold-open mechanism with a spring-loaded plunger which is uniquely prevented from slapping against the door section as the door is opened and which is held in assembled relation when the door is removed from the body along the assembly line.

Still another object of the invention is to provide a hold-open mechanism having detents formed by removable inserts which can be easily installed as required for a particular hinge.

The invention also resides in the provision of a door on-door off hinge having an intermediate hinge section which is uniquely cradled by the body section in order to improve the stability of the hinge.

These and other objects and advantages of the invention will become more apparent from the following detailed description when taken in conjunction with the accompanying drawings.

BRIEF DESCRIPTION OF THE DRAWINGS

FIGS. 5 and 6 being on an enlarged scale.

DETAILED DESCRIPTION OF THE PREFERRED EMBODIMENT

Figure 1:
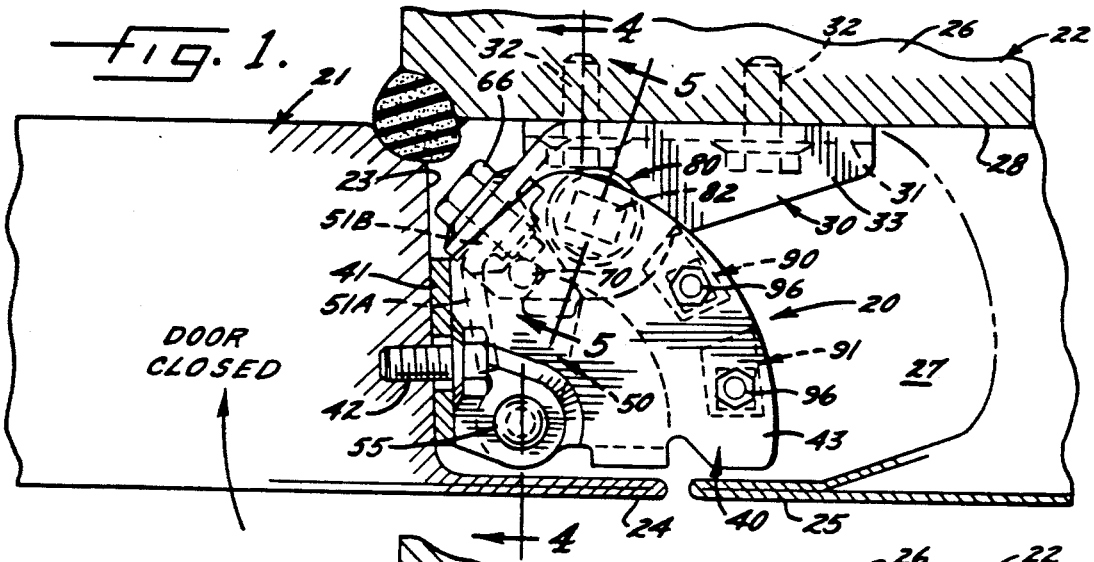
FIG. 1 is a top plan view showing one embodiment of a new and improved hinge incorporating the unique features of the present invention, the hinge being shown as installed in a vehicle with the door of the vehicle being illustrated in a closed position.

As shown in the drawings for purposes of illustration, the invention is embodied in a hinge 20 for mounting a vehicle door 21 for swinging about an upright axis and between open and closed positions on a vehicle body 22. The door which has been illustrated is a right-hand front door and includes a forwardly facing and laterally extending hinge-mounting wall 23. A sheet metal panel 24 extends forwardly from the outer side of the door and helps conceal the hinge from view from outside the vehicle. When the door 21 is closed, the hinge is also concealed from view by a rearwardly extending sheet metal panel 25 which forms part of a front fender. The fender and a body frame member 26 coact to define a cavity or well 27 which receives part of the hinge. One side of the frame member faces laterally outwardly and defines a hinge-mounting wall 28 which extends generally perpendicular to the wall 23 when the door is in a closed position.

The hinge 20 includes a body section 30 (FIGS. 4 and 5) which is anchored rigidly to the frame member 26. Specifically, the body section is stamped from a single piece of sheet metal and includes an upright web 31 which is disposed in face-to-face relation with the wall 28 of the frame member. Screws 32 extend through oversize holes in the web 31 and are threaded into the frame member 26 to attach the body section 30 of the hinge 20 to the vehicle body 22.

Figure 4:
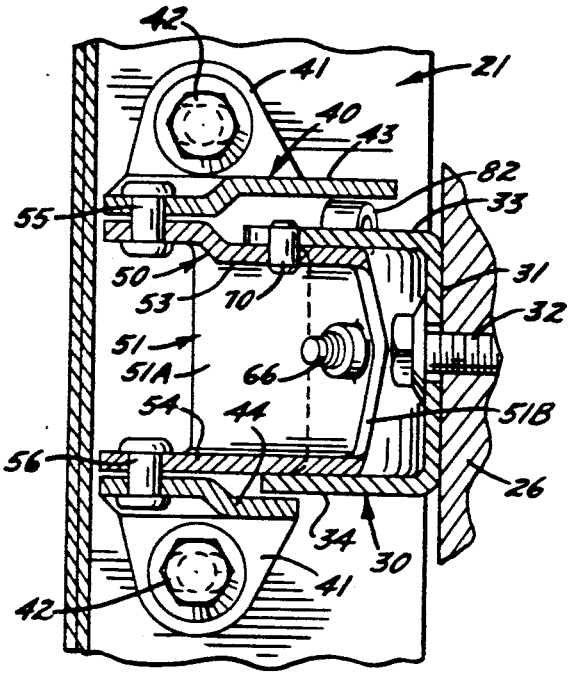
FIGS. 4, 5 and 6 are fragmentary cross-sections taken substantially along the lines 4—4, 5—5 and 6—6, respectively, of FIG. 1.

As shown in FIG. 4, the body section 30 of the hinge 20 is generally U-shaped when viewed in an upright plane extending laterally of the vehicle. Identical upper and lower plates 33 and 34 are formed integrally with the upper and lower margins, respectively, of the web 31 and extend laterally outwardly from the web. Each plate is somewhat L-shaped when viewed from above.

Figure 7:
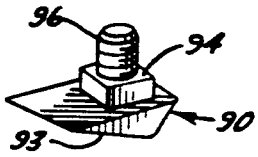
FIGS. 7 and 8 are perspective views of one of the removable inserts of the hold-open mechanism.

The hinge 20 also includes a door section 40 (FIGS. 4 and 7) having upright ears 41 which lie in face-to-face relation with the mounting wall 23 of the door 21. The door section 40 is anchored rigidly to the door 21 by screws 42 (FIG. 4) extending through oversize holes in the ears 41 and threaded into the wall 23. Upper and lower plates 43 and 44 are formed integrally with the ears and project forwardly from the ears when the door 21 is in its closed position.

In accordance with one aspect of the present invention, the body and door sections 30 and 40 are connected by an intermediate hinge section 50 which enables the door 21 to be removed from and re-installed on the body 22 in an extremely quick and easy manner. The hinge 20 is particularly characterized in that the intermediate hinge section 50 is cradled by the body section 30 in such a manner that the latter hinge section supports the weight of the door as the door is removed from and re-installed on the body and then solidly stabilizes the intermediate section once the installation has been completed.

More particularly, the intermediate hinge section 50 includes an upright web 51 (FIG. 4) stamped from sheet metal and having a portion 51A adapted to be located in front of the wall 23 when the door 21 is closed. Formed integrally with the upper and lower margins of the web 51 are upper and lower plates 53 and 54, respectively, which extend forwardly and outwardly from the web. As shown most clearly in FIG. 4, the plates 53 and 54 of the intermediate hinge section 50 are located between the plates 43 and 44 of the door section 40. An upper rivet 55 extends through the outer rear corner portions of the plates 43 and 53 while a lower rivet 56 extends through the outer rear corner portions of the plates 44 and 54. The rivets are generally vertical and support the door section 40 to swing on the intermediate section 50 and about an upright axis.

Figure 9:
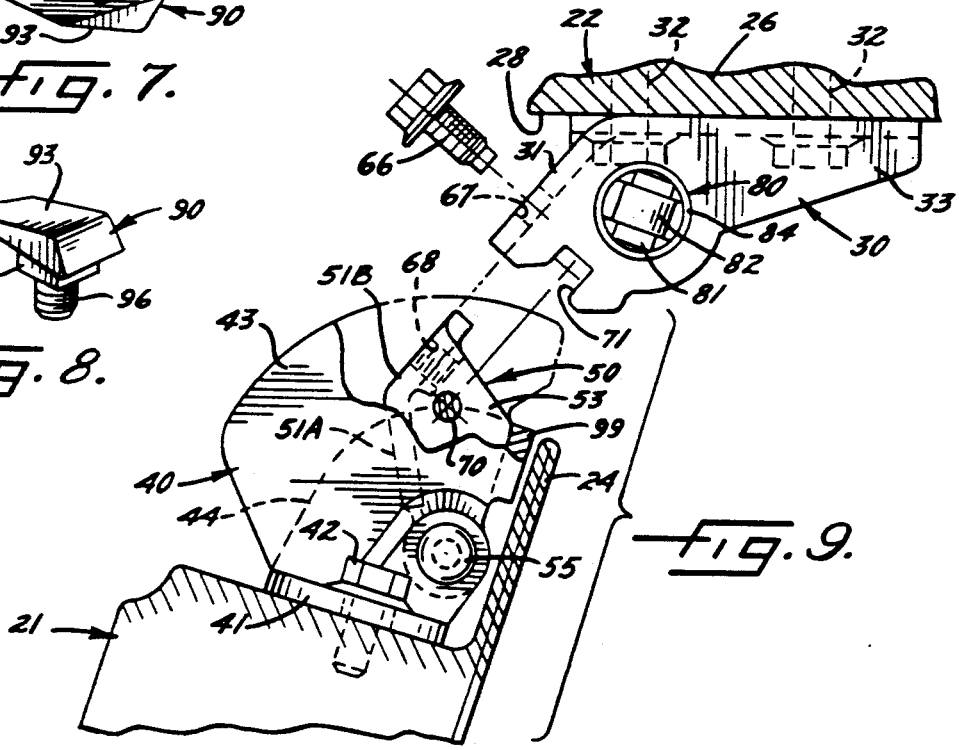
FIG. 9 is a view generally similar to FIG. 3 but shows certain parts of the hinge disassembled to permit removal and re-installation of the door.

Pursuant to the invention, the intermediate section 50 is cradled by and is attached releasably to the body section 30. As shown in FIG. 4, the upper and lower plates 53 and 54 of the intermediate section 50 are located between and are disposed in face-to-face engagement with the upper and lower plates 33 and 34 of the body section 30. A portion 51B of the web 51 of the intermediate section 50 lies face-to-face against the forward side of the web 31 of the body section 30. The two sections are connected to one another by a screw 66 extending through a hole 67 (FIG. 9) in the web 31 and threaded into a tapped hole 68 in the web portion 51B. Coacting with the screw 66 to locate the intermediate section 50 relative to the body section 30 is a pin 70 (FIGS. 4 and 9) which is anchored rigidly to the upper plate 53 of the intermediate section 51. The pin projects upwardly from the plate 51 and is received with a close fit in an outwardly opening notch 71 formed through the upper plate 33 of the body section 30 in the outer rear portion of the plate 33.

With the foregoing arrangement, the door section 40 and the intermediate section 50 are secured to the body section 30 by the screw 66 and are also located relative to the body section by virtue of the pin 70 fitting in the notch 71. The screw 66 and the pin 70 serve to secure the hinge sections 30 and 50 together at two spaced locations and precisely position the intermediate section 50 and the door section 40 with respect to the body section 30.

When the door section 40 and the intermediate section 50 are assembled to the body section 30 by the screw 66 and the pin 70, the hinge 20 may be adjusted to establish a proper fit between the door 21 and the body 22 by shifting the hinge sections 30 and 40 relative to the door and body as necessary while the mounting screws 32 and 42 are loose. After the proper fit has been achieved, the screws 32 are tightened to establish a precise positional relationship between the body 22 and the hinge section 30 and the screws 42 are tightened to establish a precise positional relationship between (A) the door 21 and (B) the door section 40 and the attached intermediate section 50. Once the screws 32 and 42 have been tightened, the screw 66 may be loosened and removed. By virtue of the plate 54 of the intermediate section 50 resting on the plate 34 of the body section 30, there is no need to provide extraneous support for the weight of the door during removal of the screw 66. Also, the pin 70 coacts with the notch 71 to hold the door in an upright position.

After the screw 66 has been removed, the door 21 may be removed from the body 22 simply by pulling outwardly on the door to slip the pin 70 horizontally out of the notch 71. When the door 21 is re-installed, it is moved reversely or inwardly until the pin 70 seats in the notch 71. Because the plates 53 and 54 are cradled between the plates 33 and 34, it is not necessary to support the weight of the door once the pin has seated in the notch. The pin coacts with the notch to stabilize the door and effect approximate alinement between the holes 67 and 68 in the web 31 and the web portion 51B. Accordingly, it is a relatively simple matter to re-install the screw 66 and re-assemble the hinge 20 since there is no need to extraneously support the weight of the door or to maneuver the door into an approximate position for re-installation.

From the foregoing, it will be apparent that the present invention brings to the art a new and improved hinge 20 which may be quickly and easily disassembled and re-assembled by virtue of the cradling of the plates 53 and 54 by the plates 33 and 34 and by virtue of the coaction of the pin 70 with the notch 71. It will be appreciated, of course, that the pin could be attached to the body section 30 and that the notch could be formed in the intermediate section 50.

The cradled relationship of the plates 53 and 54 with the plates 33 and 34 also stabilize the hinge 20 during service use. Upward and downward twisting moments applied to the door 21 and to the plates 53 and 54 are resisted by the plates 33 and 34.

According to another aspect of the invention, the hinge 20 is provided with a mechanism 80 (FIG. 5) which releasably holds the door 21 open and which, as will become apparent, is very quiet and durable. Herein, the hold-open mechanism 80 includes a spring-loaded plunger 81 whose free end portion carries a circular anti-friction roller 82 which is journaled on the plunger by a roll pin 83 to turn about an axis extending radially of the hinge axis defined by the rivets 55 and 56. The plunger is telescoped slidably into the upper and lower end portions of an upright cylindrical sleeve 84 which extends between and is fastened to the upper and lower plates 33 and 34 of the body section 30. A coil spring 85 is telescoped into the sleeve 84 and is compressed between the plunger and the lower plate 34 so as to urge the plunger upwardly. Advantageously, the plunger is prevented from projecting upwardly beyond the position shown in FIG. 5 by virtue of a collar 86 on the lower end of the plunger engaging an internal flange 87 formed within the upper end of the sleeve 84.

Figure 6:
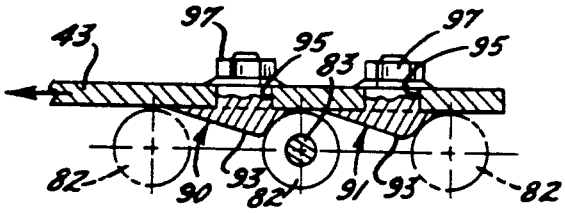

The hold-open mechanism 80 further includes detent means which coact with the plunger 88 to releasably hold the door 21 in partially open and nearly fully open positions. In the present instance, the detent means are located on the lower side of the upper plate 43 of the door section 40 and are defined by two angularly spaced detents 90 and 91 (FIG. 6). The detents are spaced from one another along an arc whose center lies on the hinge axis defined by the rivets 55 and 56.

Figure 8:
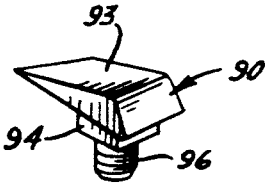

Advantageously, each of the detents 90 and 91 is a removable insert which is formed separately of the plate 43 of the door section 40. Each detent includes a generally wedge-shaped member or ramp 93 (FIGS. 7 and 8) having a square shoulder 94 which fits into a square hole 95 (FIG. 6) formed in the plate 43. A threaded stud 96 (FIG. 7) is formed integrally with the ramp 93 and projects upwardly through the hole 95. Threaded onto the stud is a nut 97 (FIG. 6) which clamps the ramp against the lower side of the upper plate 43.

When the door 21 is fully closed, the roller 82 of the plunger 81 is located at the left of the detent 90 as shown in dotted lines at the left of FIG. 6. As the door is opened, the plate 43 swings about the hinge axis and causes the detent 90 to move toward the roller. During such swinging, the roller momentarily bears against the ramp 93 of the detent 90. As a result, the spring 85 acts through the plunger 81, the roller 82 and the ramp 93 to momentarily exert a force tending to return the door 21 to a closed position.

Figure 2:
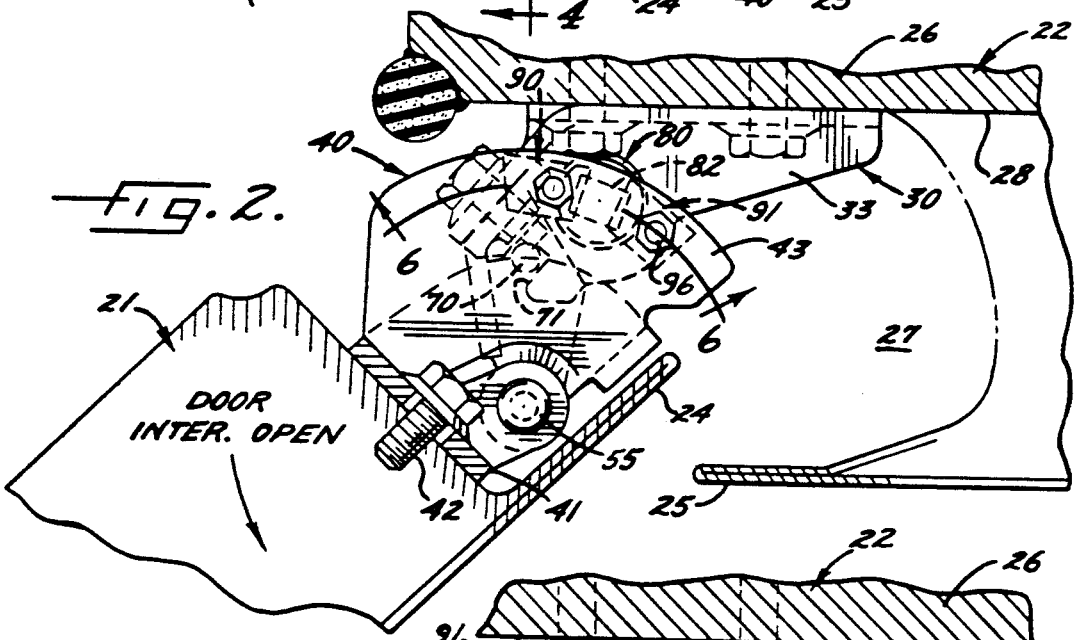
FIG. 2 is a view similar to FIG. 1 but shows the door in a partially open position.

As the door 21 is opened through a predetermined angle (herein, 45 degrees), the roller 82 seats behind the ramp 93 of the detent 90 as shown in solid lines in FIG. 6. By virtue thereof, closing motion of the door is checked and the door is releasably held against slamming closed from the partially open position shown in FIG. 2.

Figure 3:
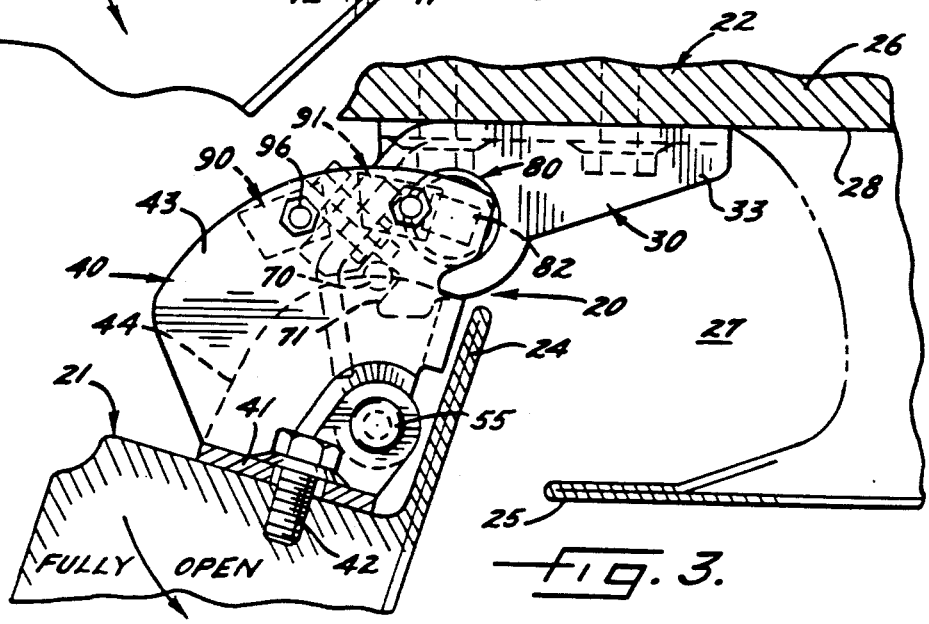
FIG. 3 is also a view similar to FIG. 1 but shows the door in a nearly fully open position.

As opening of the door 21 continues, the ramp 93 of the detent 91 rides across the roller 82. Thereafter, the roller seats behind the ramp of the detent 91 as shown by dotted lines at the right of FIG. 6. Such seating occurs in the present instance after the door has been opened through an angle of 73 degrees (see FIG. 3) and produces a snubbing action to again releasably hold the door against returning to its closed position.

After the door 21 has been checked at its nearly fully open position, it may be opened through a few more degrees (e.g., 3 degrees) to a completely open position. At this point, vertically projecting lugs 99 (FIG. 9) which are formed integrally with the plates 43 and 44 of the door section 40 engage the edges of the plates 33 and 34 of the body section 30 to stop further opening of the door.

Figure 5:
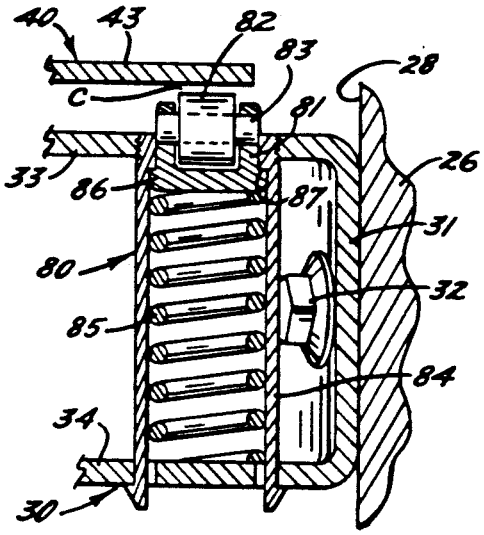

Because the collar 86 and the flange 87 coact to limit upward movement of the plunger 81, the roller 82 is held out of contact with the plate 43 and is spaced from the plate with vertical clearance as indicated by C in FIG. 5. As a result, when the roller rides onto and off of the detents 90 and 91, it does not slap against the plate. This substantially reduces noise as the door 21 is opened and closed. Moreover, wear is reduced since the roller 82 only contacts the detents 90 and 91 and does not engage the plate 43 itself as the door is opened and closed. The lack of engagement of the roller with the plate also reduces the effort required to open and close the door.

The coaction between the collar 86 and the flange 87 not only holds the roller 82 out of contact with the plate 43 but also keeps the plunger 81 and the spring 85 in assembled relation with the sleeve 84 when the door 21 is removed and the plate 43 is absent. Accordingly, the detent portion of the hold-open mechanism 80 may be removed with the door 21 while the plunger portion of the mechanism remains with the body 22 and remains in an assembled condition.

The formation of the detents 90 and 91 as removable inserts enables detents of different shapes to be used in order to produce different hold-open actions. Also, many rear doors do not have a hold-open at an intermediate position and thus the detent 90 simply is not used in some rear hinges. If the detents wear, they may be easily replaced without need of replacing the entire hinge.

I claim:

1. A hinge for mounting a door for swinging on the body of a vehicle and for releasably holding the door open, said hinge comprising a door section, an intermediate section and a body section, said door section and said body section being mountable on the vehicle door and body, respectively, means for pivotally connecting said door section to said intermediate section and supporting said door section to swing about a predetermined axis relative to said intermediate section from a closed position to an open position, means for detachably connecting said intermediate section to said body section whereby said intermediate section may be quickly released from and quickly re-attached to said body section to permit the door to be quickly removed from and re-installed on the vehicle body, detent means on said door section, and spring-loaded plunger means on said body section and positioned to engage said detent means as said door section is swung from said closed position to said open position, said plunger means being operable when in engagement with said detent means to releasably hold the door section against swinging from said open position toward said closed position, said door section including a generally horizontal plate, said detent means comprising a detent projecting generally vertically from said plate, said plunger means engaging said detent when said door section is in said open position, and means holding said plunger means out of engagement with said plate as said door section moves toward and away from said open position thereby to reduce noise during such movement.

2. A hinge as defined in claim 1 in which said plunger means further include an upright sleeve secured to said body section, a plunger telescoped slidably in said sleeve and projecting out of said sleeve, a spring biasing said plunger out of said sleeve and toward said plate, said holding means comprising coacting means on said plunger and said sleeve and limiting the extent to which said plunger projects out of said sleeve thereby to hold said plunger out of engagement with said plate.

3. A hinge as defined in claim 1 including angularly spaced detents on said plate for releasably holding said door either in a partially open position or in a more fully open position, each of said detents comprising a ramp detachably secured to said plate.

4. A hinge as defined in claim 3 further including a threaded stud connected to each of said ramps, holes in said plate and receiving said studs, and nuts on said studs for clamping said ramps to said plate.

5. A hinge for mounting a door for swinging between open and closed positions on the body of a vehicle, said hinge comprising a door section, an intermediate section and a body section, means for securing said door section and said body section to the vehicle door and body, respectively, means for pivotally connecting said intermediate section to said door section, said body section and said intermediate sections each having a generally upright web and each having upper and lower vertically spaced and generally horizontal plates, said intermediate section being cradled within said body section with the lower plate of said intermediate section resting on the lower plate of said body section, means for detachably connecting said intermediate section to said body section whereby said intermediate section may be quickly released from and quickly re-attached to said body section to permit the door to be quickly removed from and re-installed on the vehicle body, said last-mentioned means comprising an upright pinon one of the plates of one of said intermediate and body sections, a notch formed in the corresponding plate of the other of said intermediate and body sections and receiving said pin, said notch being generally U-shaped and opening generally horizontally out of said corresponding plate to enable said pin to move generally horizontally into and out of said notch, said pin and said notch coacting with said lower plates to locate said intermediate section relative to said body section, and a threaded fastener extending through said webs to releasably connect said intermediate section to said body section.

6. A hinge as defined in claim 5 in which said pin is on one of the plates of said intermediate section, said notch being formed in the corresponding plate of said body section.

* * * * *